US008043122B1

(12) United States Patent
Cho et al.

(10) Patent No.: US 8,043,122 B1
(45) Date of Patent: Oct. 25, 2011

(54) PORTABLE DOCK AND POWER ADAPTER SYSTEM

(75) Inventors: Sudong Cho, Austin, TX (US); Antonio Latto, Austin, TX (US); Kenneth C. Musgrave, Austin, TX (US); Paul Doczy, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 12/855,490

(22) Filed: Aug. 12, 2010

(51) Int. Cl.
*H01R 25/00* (2006.01)

(52) U.S. Cl. ..... 439/638; 439/501; 439/652; 439/639

(58) Field of Classification Search ..... 439/501, 439/652, 638, 639
See application file for complete search history.

(56) References Cited

U.S. PATENT DOCUMENTS 6,325,665 B1 12/2001 Chung
6,433,274 B1 8/2002 Doss et al.
7,911,757 B2 * 3/2011 Hsu et al. ..... 361/118
2005/0060467 A1 3/2005 Wieck
2008/0246343 A1 10/2008 Xu

* cited by examiner

*Primary Examiner* — Tho D Ta
(74) *Attorney, Agent, or Firm* — Haynes and Boone, LLP

(57) ABSTRACT

A portable dock and power adapter system includes a dock member having a power adapter member coupling, a plurality of IHS component connectors, and a dock plug that is electrically coupled to the plurality of IHS component connectors and extends from the dock member. The portable dock and power adapter system also includes power adapter member including a dock member coupling and a power adapter plug that is electrically coupled to the dock plug and that extends from the power adapter member. A connecting member extends between the power adapter member and the dock member. The connecting member is operable to orient the power adapter member and the dock member such that the dock member coupling is spaced apart from the power adapter member coupling. The connecting member is also operable to orient the power adapter member and the dock member such that the dock member coupling engages the power adapter member coupling.

20 Claims, 10 Drawing Sheets

PORTABLE DOCK AND POWER ADAPTER SYSTEM

BACKGROUND

The present disclosure relates generally to information handling systems, and more particularly to portable dock and power adapter system for an information handling system.

As the value and use of information continues to increase, individuals and businesses seek additional ways to process and store information. One option is an information handling system (IHS). An IHS generally processes, compiles, stores, and/or communicates information or data for business, personal, or other purposes. Because technology and information handling needs and requirements may vary between different applications, IHSs may also vary regarding what information is handled, how the information is handled, how much information is processed, stored, or communicated, and how quickly and efficiently the information may be processed, stored, or communicated. The variations in IHSs allow for IHSs to be general or configured for a specific user or specific use such as financial transaction processing, airline reservations, enterprise data storage, or global communications. In addition, IHSs may include a variety of hardware and software components that may be configured to process, store, and communicate information and may include one or more computer systems, data storage systems, and networking systems.

Some IHSs such as, for example, portable IHSs, are used with docking stations that enable the portable IHS to be easily and quickly connected and disconnected from a plurality of peripheral components that are connected to the docking station. Such docking stations increase the functionality of the portable IHS when it is connected to the docking station, while also enabling full portability of the portable IHS when it is disconnected from the docking station. However, conventional docking stations are typically designed with limited portability, which limits docking station functionality to a chosen location of the docking station. Furthermore, conventional docking stations typically include a specialized docking connector, which necessitates a specialized mating connector on the portable IHS and raises the costs of the portable IHS.

Accordingly, it would be desirable to provide an improved docking station.

SUMMARY

A portable dock and power adapter system includes a dock member including a power adapter member coupling, a plurality of IHS component connectors, and a dock plug that is electrically coupled to the plurality of IHS component connectors and extends from the dock member, a power adapter member including a dock member coupling and a power adapter plug that is electrically coupled to the dock plug and that extends from the power adapter member, and a connecting member extending between the power adapter member and the dock member, wherein the connecting member is operable to orient the power adapter member and the dock member such that the dock member coupling is spaced apart from the power adapter member coupling, and wherein the connecting member is operable to orient the power adapter member and the dock member such that the dock member coupling engages the power adapter member coupling.

DETAILED DESCRIPTION

For purposes of this disclosure, an IHS may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an IHS may be a personal computer, a PDA, a consumer electronic device, a display device or monitor, a network server or storage device, a switch router or other network communication device, or any other suitable device and may vary in size, shape, performance, functionality, and price. The IHS may include memory, one or more processing resources such as a central processing unit (CPU) or hardware or software control logic. Additional components of the IHS may include one or more storage devices, one or more communications ports for communicating with external devices as well as various input and output (I/O) devices, such as a keyboard, a mouse, and a video display. The IHS may also include one or more buses operable to transmit communications between the various hardware components.

Figure 1:
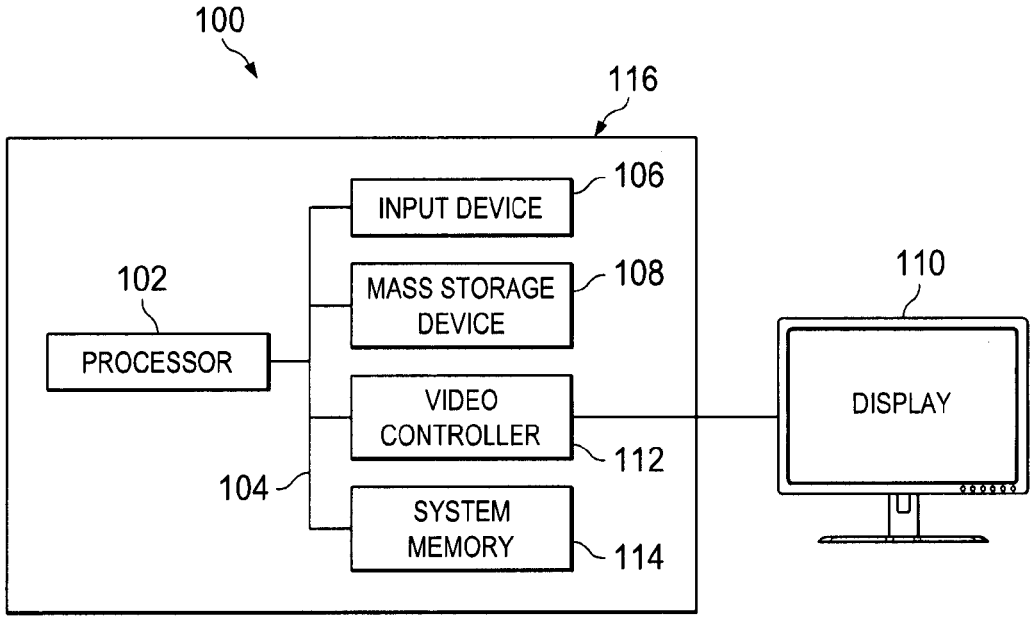
FIG. 1 is a schematic view illustrating an embodiment of an IHS.
Figure 4A:
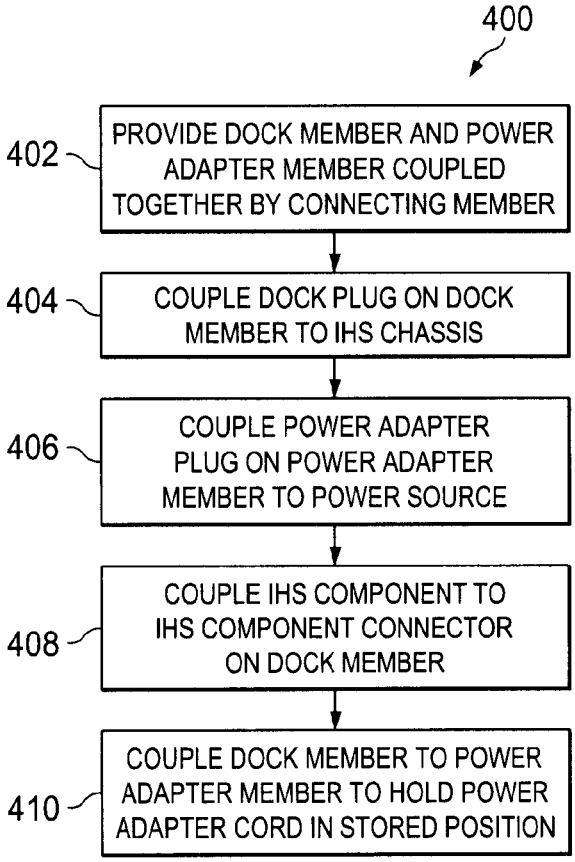
FIG. 4*a* is a flow chart illustrating an embodiment of a method for providing a dock and power to an IHS.

In one embodiment, IHS 100, FIG. 1, includes a processor 102, which is connected to a bus 104. Bus 104 serves as a connection between processor 102 and other components of IHS 100. An input device 106 is coupled to processor 102 to provide input to processor 102. Examples of input devices may include keyboards, touchscreens, pointing devices such as mouses, trackballs, and trackpads, and/or a variety of other input devices known in the art. Programs and data are stored on a mass storage device 108, which is coupled to processor 102. Examples of mass storage devices may include hard discs, optical disks, magneto-optical discs, solid-state storage devices, and/or a variety other mass storage devices known in the art. IHS 100 further includes a display 110, which is coupled to processor 102 by a video controller 112. A system memory 114 is coupled to processor 102 to provide the processor with fast storage to facilitate execution of computer programs by processor 102. Examples of system memory may include random access memory (RAM) devices such as dynamic RAM (DRAM), synchronous DRAM (SDRAM), solid state memory devices, and/or a variety of other memory devices known in the art. In an embodiment, a chassis 116 houses some or all of the components of IHS 100. It should be understood that other buses and intermediate circuits can be deployed between the components described above and processor 102 to facilitate interconnection between the components and the processor 102.

Figure 2:
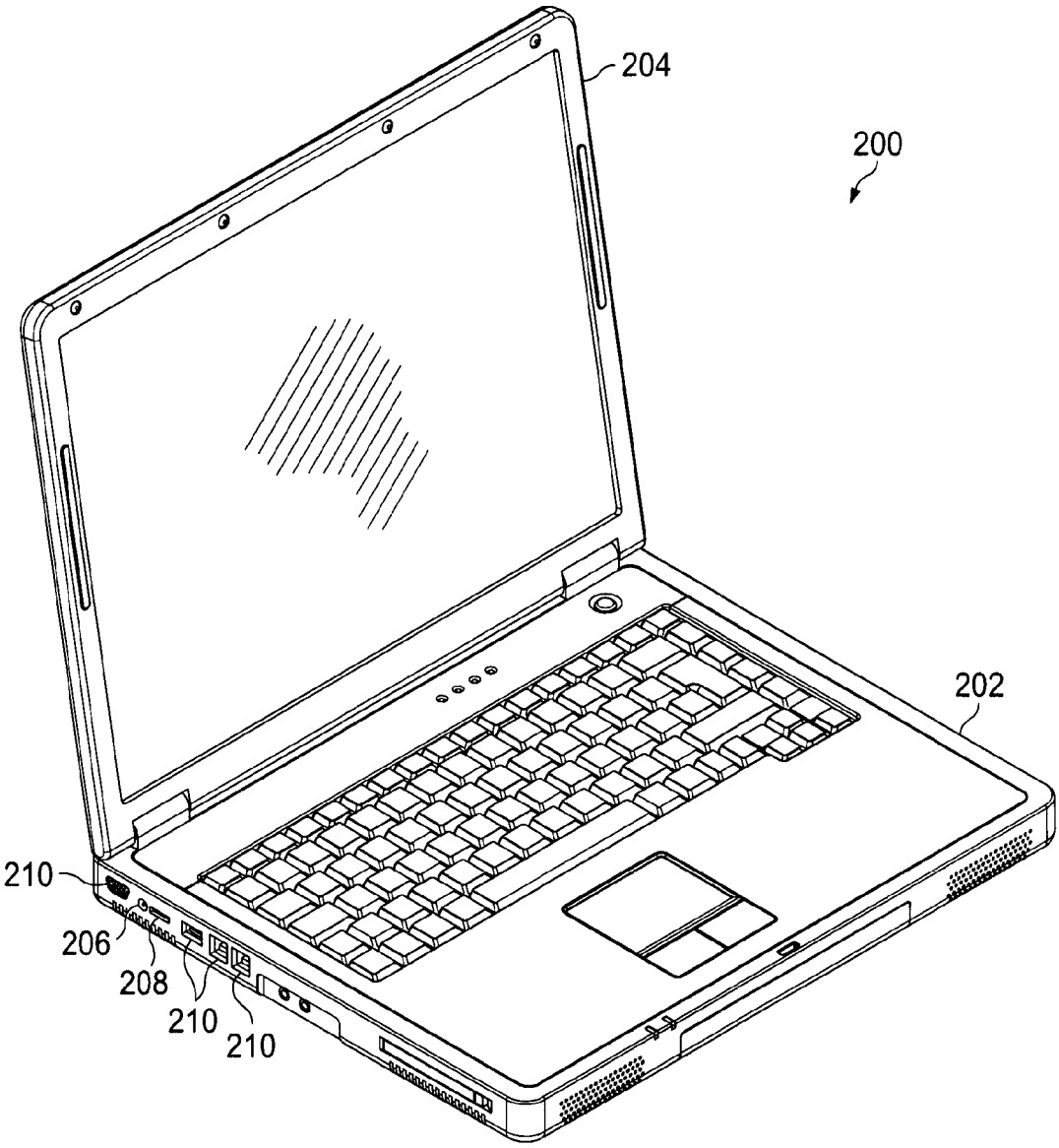
FIG. 2 is a perspective view illustrating an embodiment of an IHS chassis.
Figure 3A:
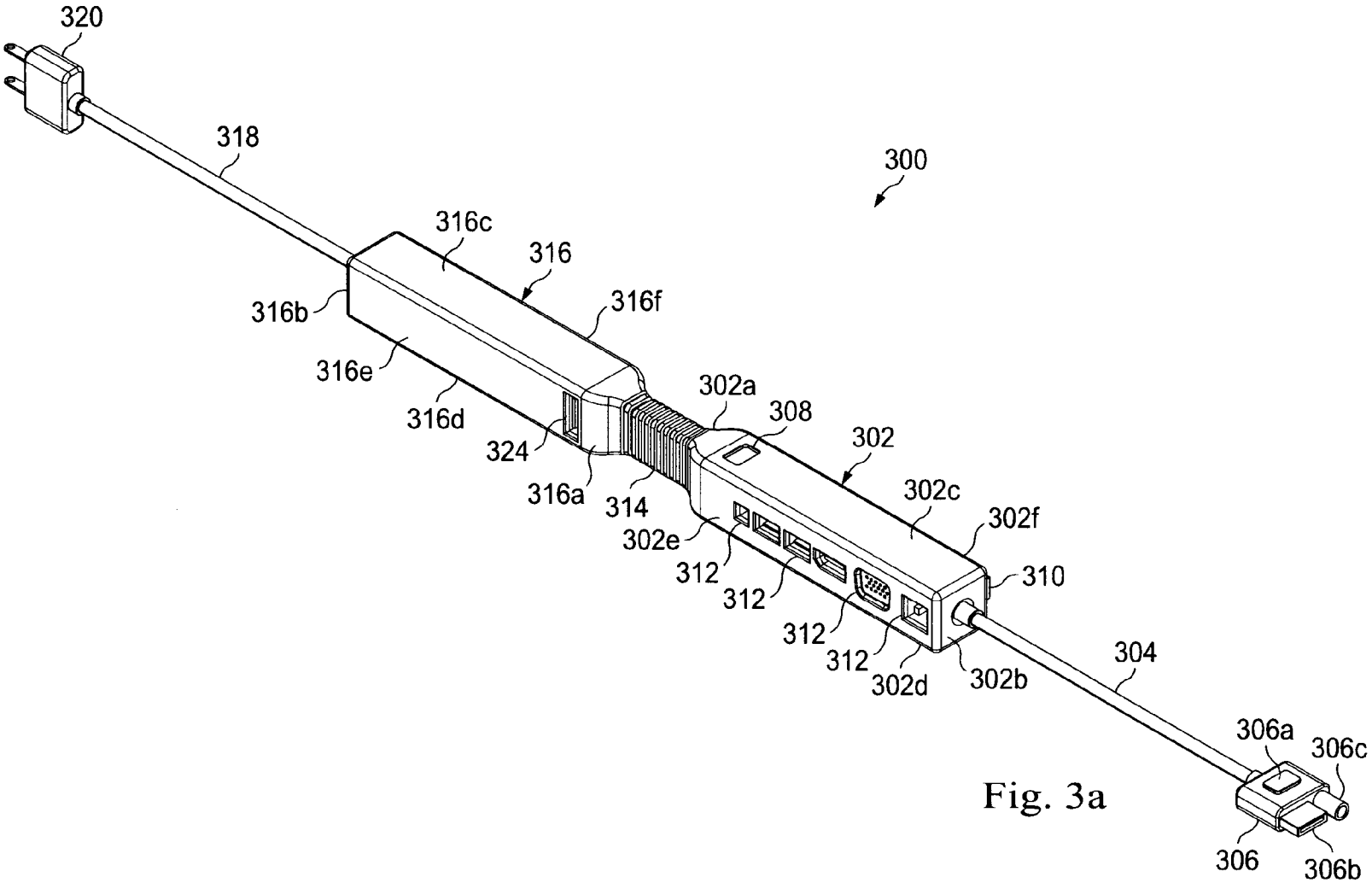
FIG. 3*a* is a perspective view illustrating an embodiment of a dock and power adapter system used with the IHS of FIG. 2.
Figure 3B:
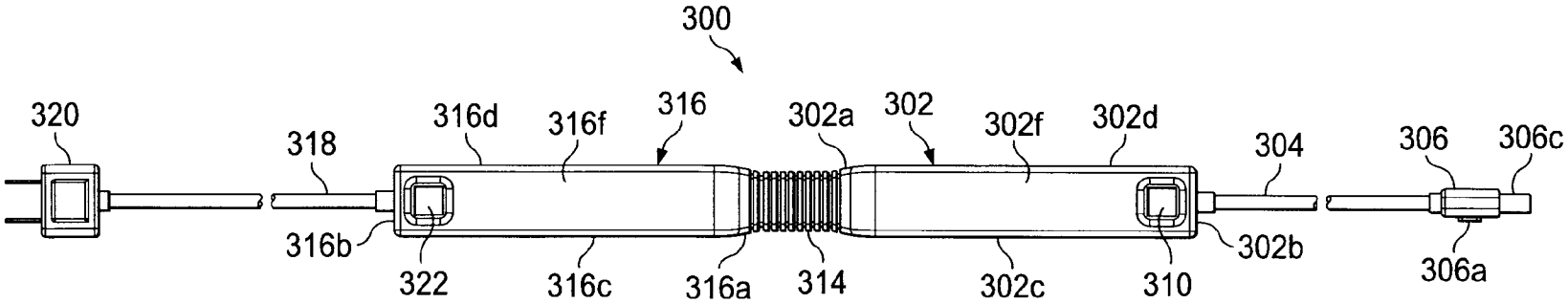
FIG. 3*b* is a side view illustrating an embodiment of the dock and power adapter system of FIG. 3*a*.
Figure 3C:
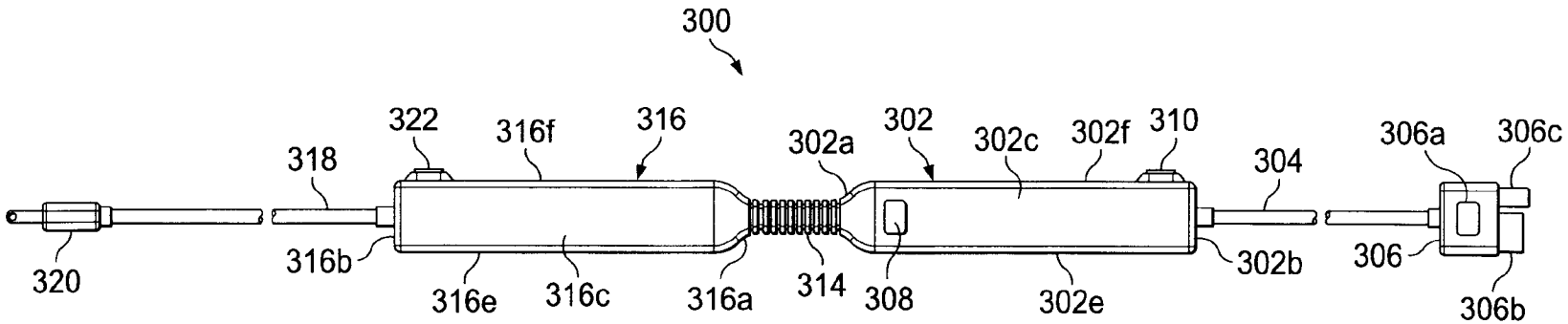
FIG. 3*c* is a top view illustrating an embodiment of the dock and power adapter system of FIG. 3*a*.
Figure 3D:
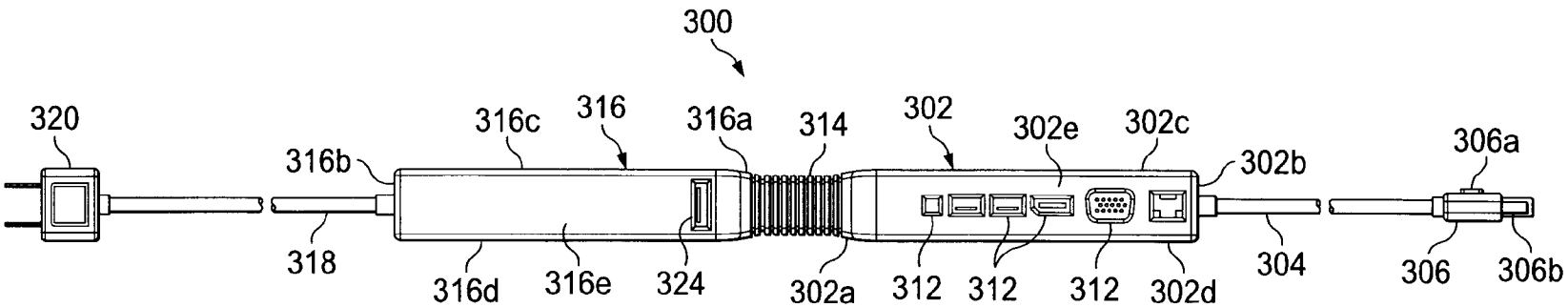
FIG. 3*d* is a side view illustrating an embodiment of the dock and power adapter system of FIG. 3*a*.
Figure 3E:
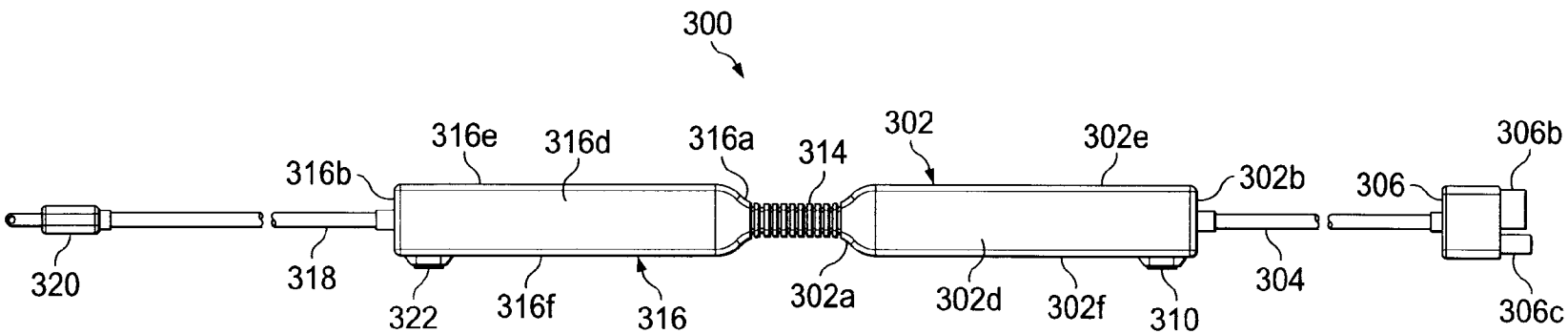
FIG. 3*e* is a bottom view illustrating an embodiment of the dock and power adapter system of FIG. 3*a*.

Referring now to FIG. 2, an IHS 200 is illustrated. In the illustrated embodiment, the IHS 200 is a portable IHS such as, for example, a notebook computer. However, one of skill in the art will recognize that the IHS 200 may be a variety of other IHSs (e.g., a desktop computer, a tablet computer, a phone, etc.) without departing from the scope of the present disclosure. The IHS 200 includes an IHS chassis base 202 that may be, for example, the chassis 116 described above with reference to FIG. 1, and that may house some or all of the IHS chassis components, described above with reference to FIG. 1. A display 204 is movably coupled to the chassis base 202 as is known in the art. An IHS power connector 206 is located on the chassis base 202 and may be coupled to the display 204 and IHS components that are housed in the chassis base 202. An IHS data connector 208 is located on the chassis base 202 adjacent the IHS power connector 206 and may be coupled to the display 204 and/or other IHS components that are housed in the chassis base 202. In an embodiment, the IHS data connector 208 may be a DisplayPort connector that may conform to standards set by the Video Electronics Standards Association (VESA), a High-Definition Multimedia Interface (HDMI) connector, and/or other data connectors known in the art. In an embodiment, the IHS power connector 206 is a conventional power connector known in the art for coupling a power adapter (e.g., an AC/DC adapter) to an IHS. In an embodiment, the IHS data connector 208 is a conventional data connector known in the art for coupling a single IHS component to an IHS. A plurality of additional IHS connectors 210 are located on the chassis base 202 and may be coupled to the display 204 and/or other IHS components that are housed in the chassis base 202.

Referring now to FIGS. 3*a*, 3*b*, 3*c*, 3*d*, and 3*e*, portable dock and power adapter system 300 is illustrated. The portable dock and power adapter system 300 includes a dock member 302 having a first end 302*a*, a second end 302*b* located opposite the dock member 302 from the first end 302*a*, a top surface 302*c* that extends between the first end 302*a* and the second end 302*b*, a bottom surface 302*d* that is located opposite the dock member 302 from the top surface 302*c* and extends between the first end 302*a* and the second end 302*b*, a side surface 302*e* that extends between the first end 302*a*, the second end 302*b*, the top surface 302*c*, and the bottom surface 302*d*, and a side surface 302*f* that is located opposite the dock member 302 from the side surface 302*e* and extends between the first end 302*a*, the second end 302*b*, the top surface 302*c*, and the bottom surface 302*d*.

A dock cord 304 extends from the second end 302*b* of the dock member 302, and includes a dock plug 306 located on its distal end. The dock plug 306 includes a dock member coupling 306*a* that, in the illustrated embodiment, extends from a surface on the dock plug 306. The dock plug 306 also includes a data coupling 306*b* and a power coupling 306*b* that extend from a surface of the dock plug 306 in an adjacent and spaced apart orientation from each other. In an embodiment, the data coupling 306*b* may be a DisplayPort coupling that may conform to standards set by the VESA, an HDMI coupling, or other data couplings known in the art. In an embodiment, the data coupling 306*b* is a conventional data coupling known in the art which is conventionally used for coupling a single IHS component to an IHS. In an embodiment, the power coupling 306*a* is a conventional power coupling known in the art which is conventionally used for coupling a power adapter (e.g., an AC/DC adapter), to an IHS. While two specific electrical couplings (i.e., the data coupling 306*b* and the power coupling 306*c*) have been described, one of skill in the art will recognize that a single electrical coupling and/or variety of different electrical couplings may be used without departing from the scope of the present disclosure. A dock plug coupling 308 is located on the top surface 302*c* of the dock member 302 and, in the illustrated embodiment, is defined by the dock member 302 and extends into the dock member 302 from the top surface 302*c*. A power adapter member coupling 310 is located on the dock member 302 and, in the illustrated embodiment, extends from the side surface 302*f* from a location on the side surface 302*f* that is adjacent the second end 302*b* of the dock member 302. A plurality of IHS component connectors 312 are located on the side surface 302*e* of the dock member 302 and may be electrically coupled to the data coupling 306*b* and/or the power coupling 306*c* through the dock member 302 and the dock cord 304. In an embodiment, the IHS component connectors 312 may include Universal Serial Bus (USB) connectors, DisplayPort connectors, HDMI connectors, RJ45 network connectors, Digital Visual Interface (DVI) connectors, and/or a variety of other IHS component connectors known in the art.

A connecting member 314 extends from the first end 302*a* of the dock member 302. In the illustrated embodiment, the connecting member 314 is a flexible member whose range of flexible motion will be described in further detail below. The portable dock and power adapter system 300 also includes a power adapter member 316 having a first end 316*a*, a second end 316*b* located opposite the power adapter member 316 from the first end 316*a*, a top surface 316*c* that extends between the first end 316*a* and the second end 316*b*, a bottom surface 316*d* that is located opposite the power adapter member 316 from the top surface 316*c* and extends between the first end 316*a* and the second end 316*b*, a side surface 316*e* that extends between the first end 316*a*, the second end 316*b*, the top surface 316*c*, and the bottom surface 316*d*, and a side surface 316*f* that is located opposite the power adapter member 316 from the side surface 316*e* and extends between the first end 316*a*, the second end 316*b*, the top surface 316*c*, and the bottom surface 316*d*. In an embodiment, the power adapter member 316 houses components for converting an alternating current (AC) to a direct current (AC) to provide an AC/DC adapter. The connecting member 314 extends from the first end 316*a* of the power adapter member 316 and between the power adapter member 316 and the dock member 302.

A power adapter cord 318 extends from the second end 316*b* of the power adapter member 316, and includes a power adapter plug 320 located on its distal end. A dock member coupling 322 is located on the power adapter member 316 and, in the illustrated embodiment, extends from the side surface 316*f* from a location on the side surface 316*f* that is adjacent the second end 316*b* of the power adapter member 316 and includes a channel that is dimensioned to accept and mate with the power adapter member coupling 310, described in further detail below. An IHS component connector 324 is located on the side surface 316*e* of the power adapter member 316 and may be electrically coupled to the power adapter plug 320 through the power adapter member 316 and the power adapter cord 318. The IHS component connector 324 may also be coupled to the data coupling 306*b* and/or the power coupling 306*c* through the power adapter member 316, the connecting member 314, the dock member 302, and the dock cord 304. In an embodiment, the IHS component connector 324 may include a USB connector and/or a variety of other connectors known in the art. Furthermore, the plurality of IHS component connectors 312 located on the side surface 302*e* of the dock member 302 may be electrically coupled to the power adapter plug 320 through the dock member 302, the connecting member 314, the power adapter member 316, and the power adapter cord 318, and the data coupling 306*b* and/or the power coupling 306*c* may be electrically coupled to the power adapter plug 320 through the dock cord 304, the dock member 302, the connecting member 314, the power adapter member 316, and the power adapter cord 318.

Figure 4B:
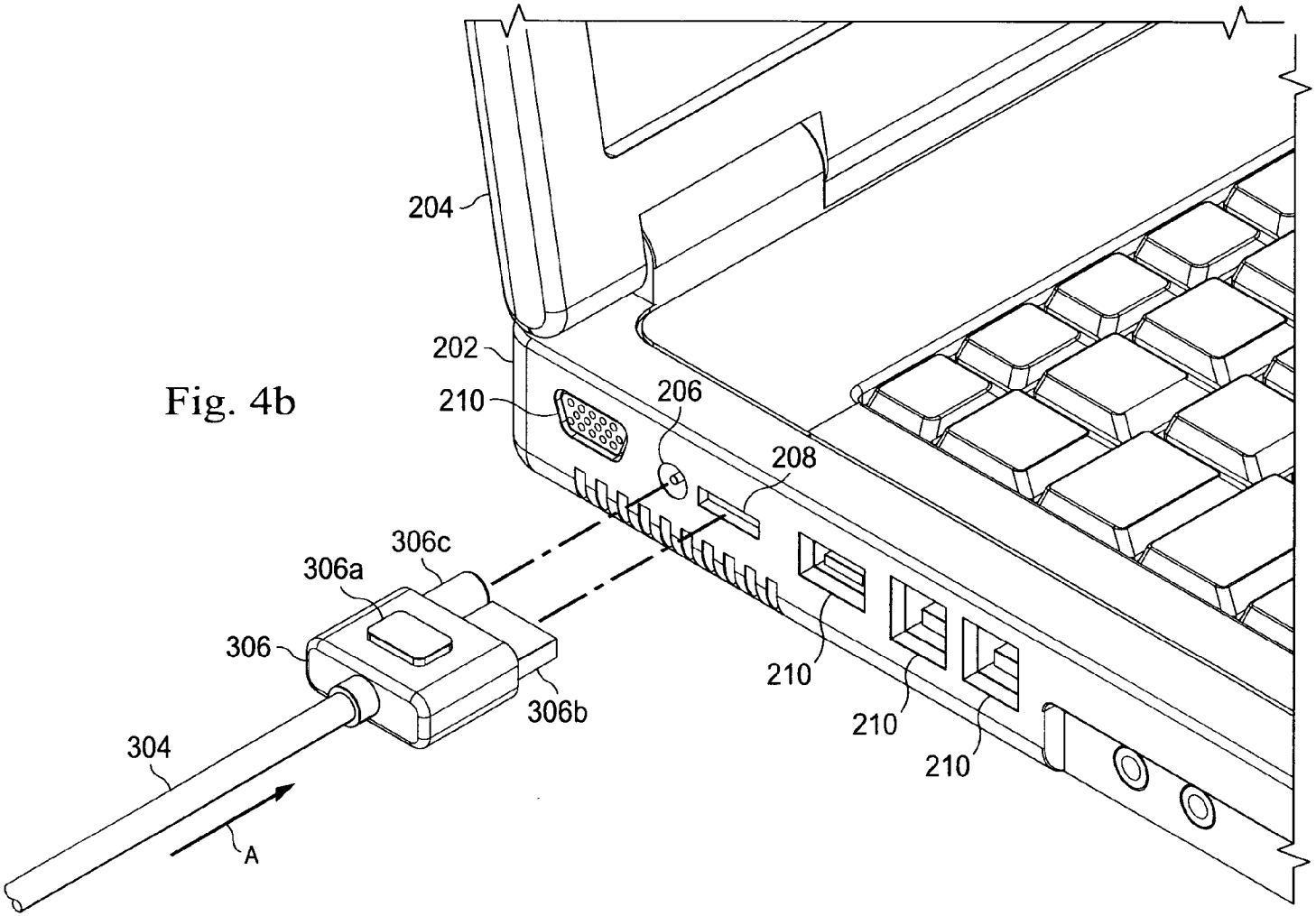
FIG. 4*b* is a perspective view illustrating an embodiment of the dock and power adapter system of FIGS. 3*a*, 3*b*, 3*c*, 3*d*, and 3*e* being coupled to the IHS of FIG. 2.
Figure 4C:
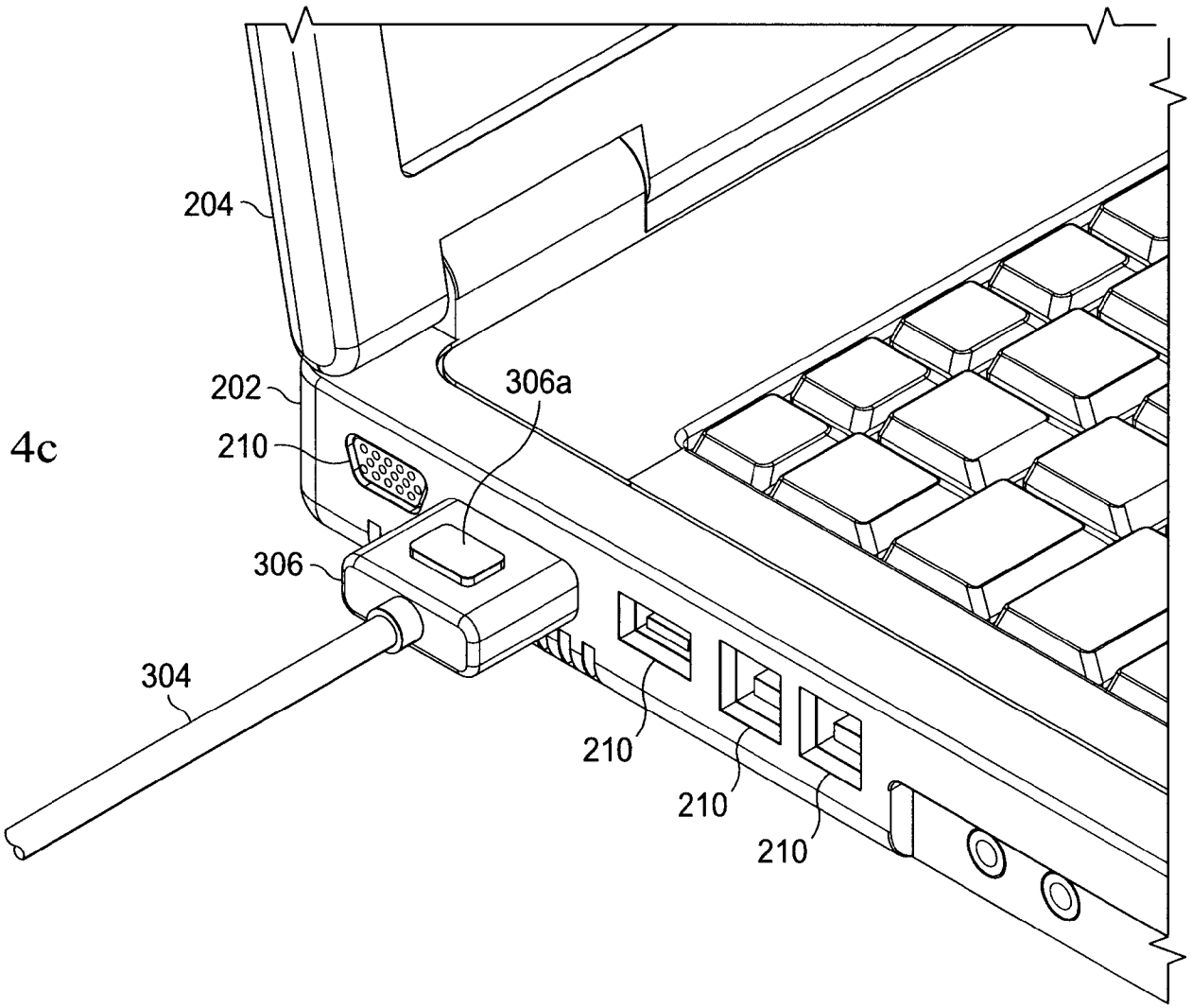
FIG. 4*c* is a perspective view illustrating an embodiment of the dock and power adapter system of FIGS. 3*a*, 3*b*, 3*c*, 3*d*, and 3*e* coupled to the IHS of FIG. 2.

Referring now to FIGS. 3*a*, 3*b*, 3*c*, 3*d*, 3*e*, 4*a*, 4*b*, and 4*c*, a method 400 for providing a dock and power to an IHS is illustrated. The method 400 begins at block 402 where a dock member coupled to power adapter member by a connecting member is provided. In an embodiment, the dock and power adapter system 300, described above with reference to FIGS. 3*a*, 3*b*, 3*c*, 3*d*, and 3*e*, is provided. The method 400 then proceeds to block 404 where the dock plug on the dock member is coupled to an IHS chassis. The IHS 200, described above with reference to FIG. 2, is provided. The dock plug 306 that extends from the dock member 302 on the dock and power adapter system 300 is positioned adjacent the chassis base 202 on the IHS 200 such that the data coupling 306*b* on the dock plug 306 is aligned with the IHS data connector 208 on the IHS 200 and the power coupling 306*c* on the dock plug 306 is aligned with the IHS power connector 206 on the IHS 200, as illustrated in FIG. 4*b*. The dock plug 306 is then moved in a direction A towards the chassis base 202 such that the data coupling 306*b* mates with the IHS data connector 208 and the power coupling 306*c* mates with the IHS power connector 206, as illustrated in FIG. 4*c*. Thus, in an embodiment, the single dock plug 306 utilizes two standard IHS connectors 206 and 208 on the IHS 200.

Figure 4D:
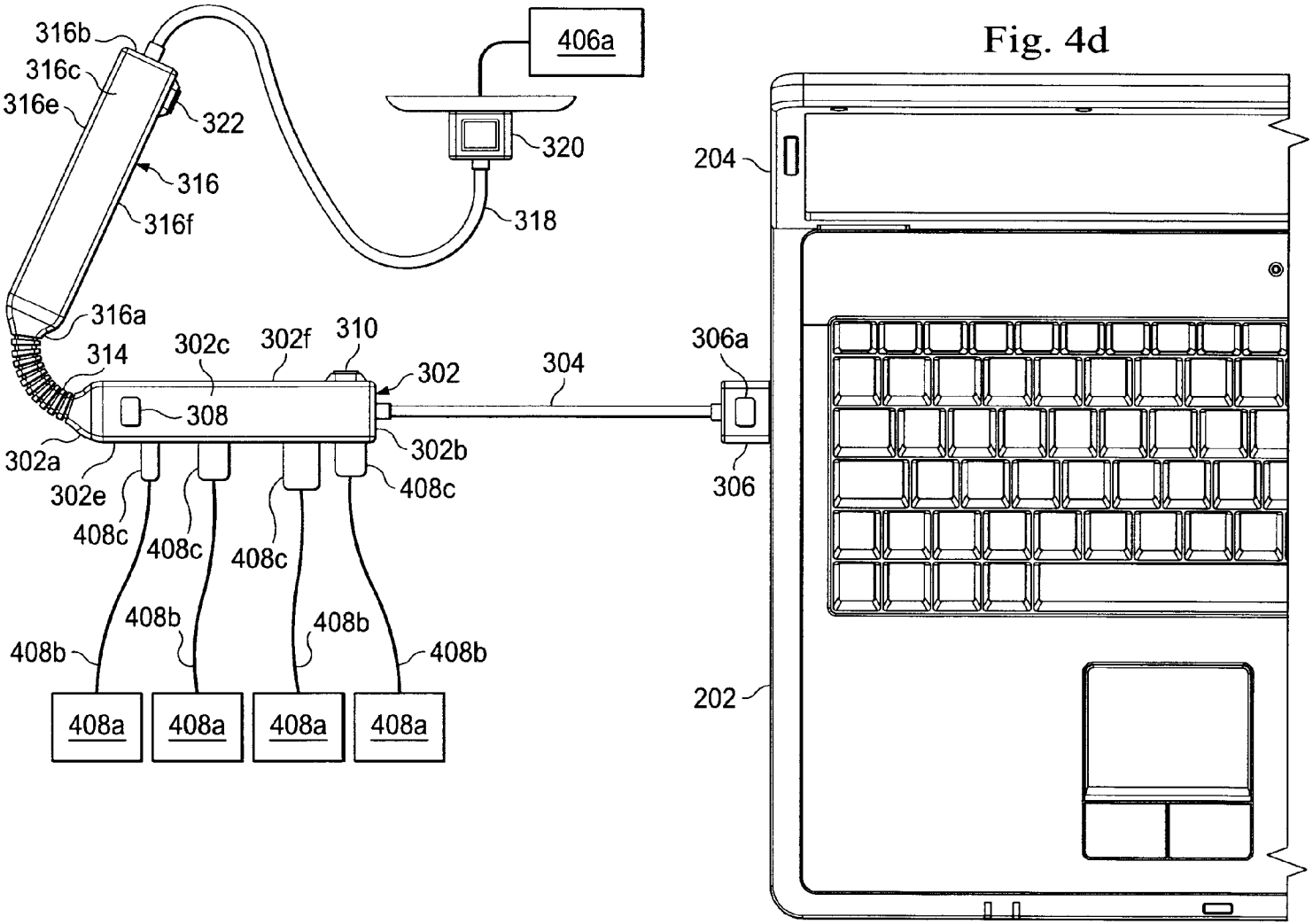
FIG. 4*d* is a perspective view illustrating an embodiment of the dock and power adapter system of FIGS. 3*a*, 3*b*, 3*c*, 3*d*, and 3*e* coupled to the IHS of FIG. 2 and a power source.

Referring now to FIGS. 3*a*, 3*b*, 3*c*, 3*d*, 3*e*, 4*a*, and 4*d*, the method 400 proceeds to block 406 where a power adapter plug on the power adapter member is coupled to a power source. A power source 406*a* is provided. In the illustrated embodiment, the power source 408*a* is an AC power source known in the art. However, one of skill in the art will recognize that the power source 406*a* may be a variety of different power sources known in the art without departing from the scope of the present disclosure. The power adapter plug 320 is coupled to the power source 406*a* through, for example, a wall coupling as illustrated in FIG. 4*d*. With the power adapter plug 320 coupled to the power source 406*a* and the dock plug 306 coupled to the IHS 200, power may be supplied to the dock and power adapter system 300 and through the dock and power adapter system 300 to the IHS 200. For example, an AC current may be supplied by the power source 406*a*, through the power adapter plug 320 and the power adapter cord 318, to the power adapter member 316 where that AC current is converted to a DC current. That DC current may then be provided directly to the IHS component connector 324, through the connecting member 314 and the dock member 302 to the IHS components connectors 324, and/or through the connecting member 314, the dock member 302, the dock cord 304, the dock plug 306, and the power coupling 306*c* to the IHS 200 (or, for example, to the processor 102 in the IHS 100, described above with reference to FIG. 1). In an embodiment, power also may be supplied through the data coupling 306*d*.

Referring now to FIGS. 3*a*, 3*b*, 3*c*, 3*d*, 3*e*, 4*a*, and 4*d*, the method 400 proceeds to block 408 where an IHS component is coupled to an IHS component connector on the dock member. A plurality of IHS components 408*a* are provided that include component cords 408*b* having component plugs 408*c* on their distal ends. The component plugs 408*c* may be mated with the IHS component connectors 312 by matching the appropriate type of component plug 408*c* with the respective appropriate IHS component connector 312, as illustrated in FIG. 4*d*. Data may then be sent back and forth from the IHS components 408*a* to the IHS 200 (or, for example, to the processor 102 in the IHS 100, described above with reference to FIG. 1) through the dock member 302, the dock cord 304, the dock plug 306, and the data coupling 306*b*. An IHS component similar to the IHS components 408*a* may also be coupled to the IHS component connector 324 to, for example, provide power to that IHS component. In an embodiment, the IHS components 408*a* may be, for example, input devices such as keyboards, pointing devices (e.g., a mouse), etc., peripheral devices such as printers, scanners, drives, etc., and/or a variety of other IHS components known in the art. Thus, with the dock and power adapter system 300 coupled to the IHS 200 and/or the IHS components 408*a*, the power adapter member 316 provides power to the IHS 200 while the dock member 302 provides an expansion dock for coupling multiple IHS components 408*a* to the IHS 200 and transferring data between the IHS components 408*a* and the IHS 200.

Figure 4E:
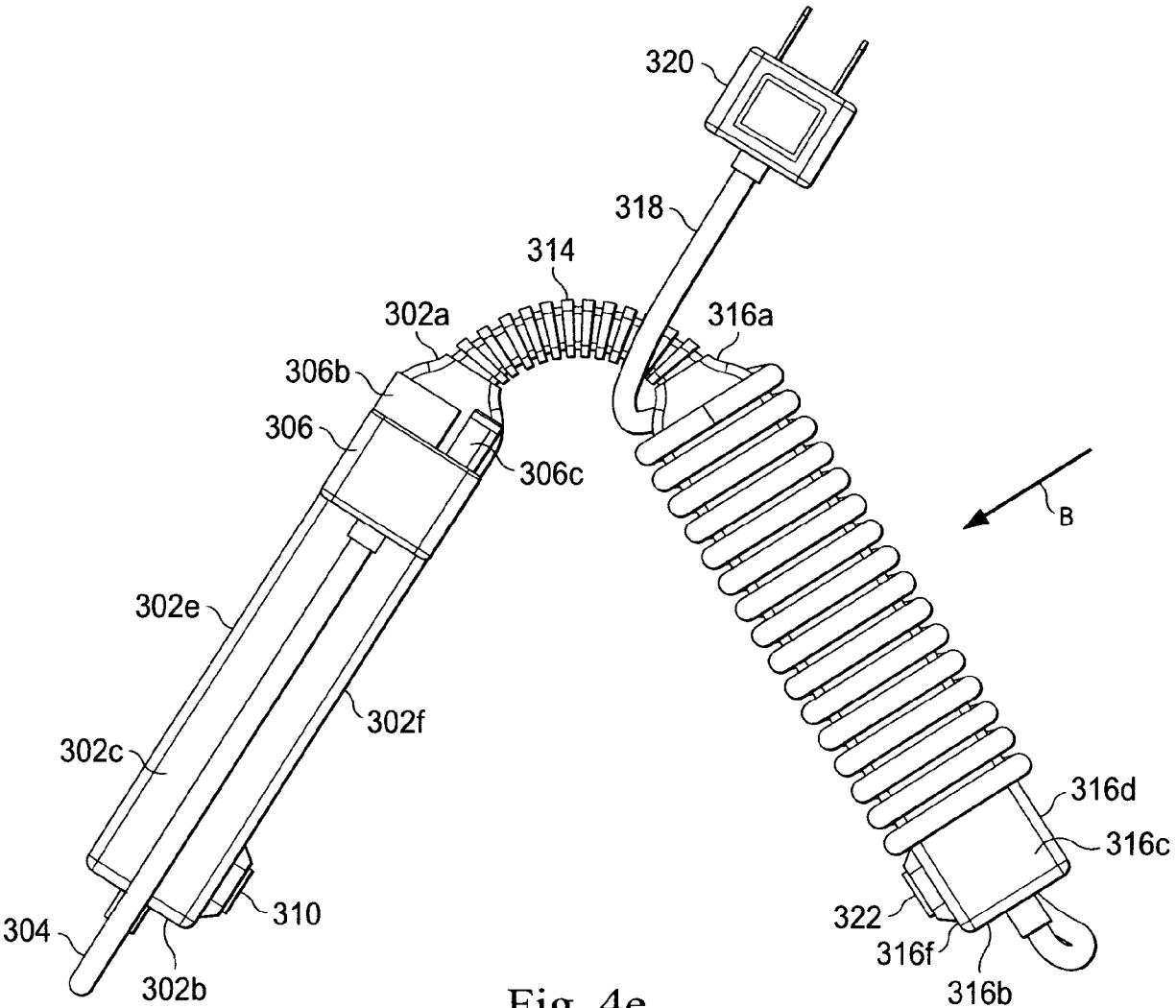
FIG. 4*e* is a perspective view illustrating an embodiment of the dock and power adapter system of FIGS. 3*a*, 3*b*, 3*c*, 3*d*, and 3*e* being oriented to store a cord.
Figure 4F:
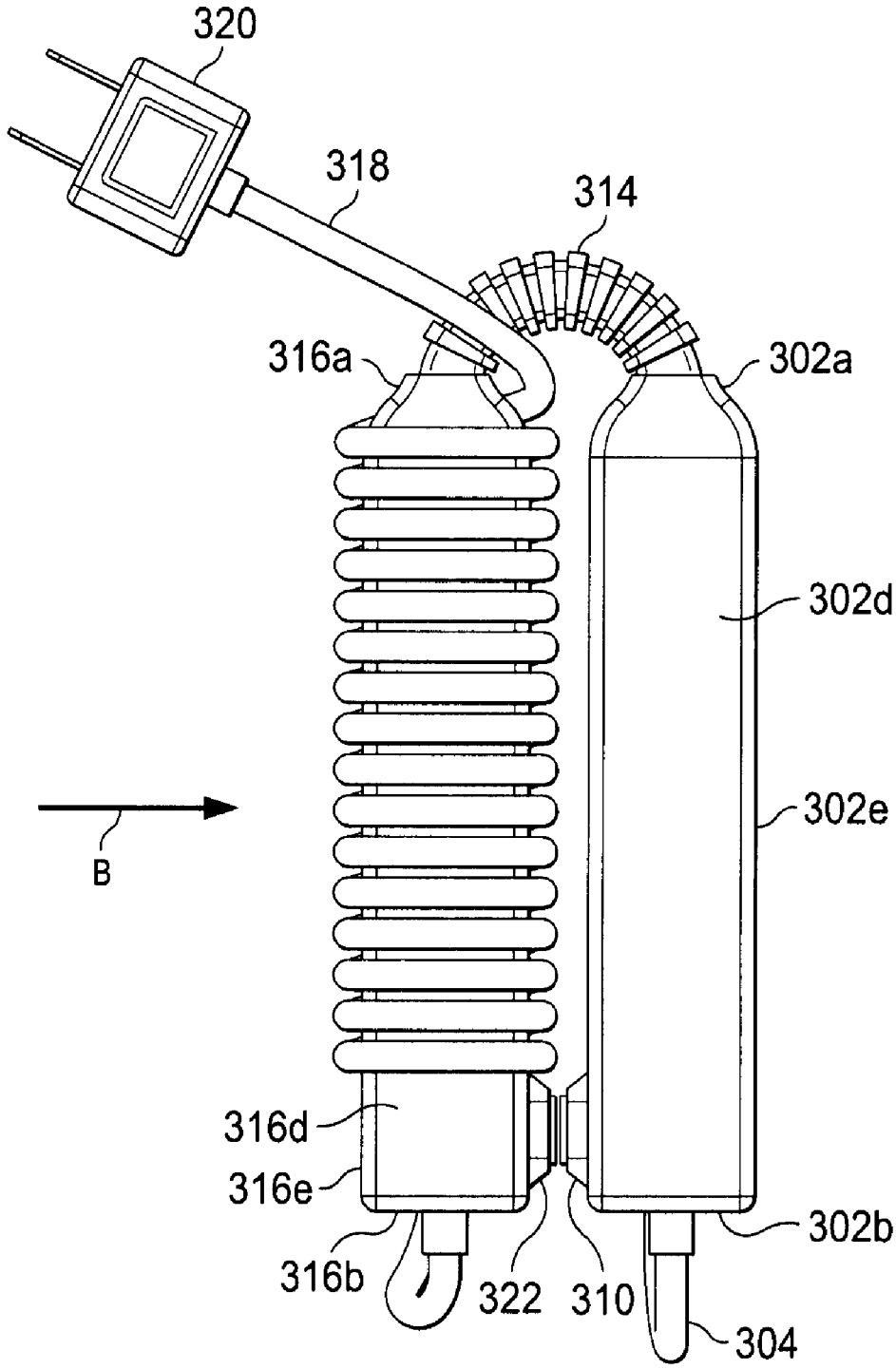
FIG. 4*f* is a perspective view illustrating an embodiment of the dock and power adapter system of FIGS. 3*a*, 3*b*, 3*c*, 3*d*, and 3*e* oriented to store a cord.

Referring now to FIGS. 3*a*, 3*b*, 3*c*, 3*d*, 3*e*, 4*a*, 4*e*, and 4*f*, the method 400 proceeds to block 410 where the dock member is coupled to the power member to hold a power adapter cord in a stored position. When the IHS 200 no longer needs power and no longer needs to be connected to the IHS components 408*a*, the power adapter plug 320 may be decoupled from the power source 406*a*, the data coupling 306*b* and the power coupling 306*c* on the dock plug 306 may be decoupled from the IHS data connector 208 and the IHS power connector 206 on the IHS 200, and the component plugs 408*c* extending from the IHS components 408*a* may be decoupled from the IHS component connectors 312 on the dock member 302. The dock plug 306 may then be coupled to the dock member 302 by engaging the dock member coupling 306*a* on the dock plug 306 with the dock plug coupling 308 on the dock member 302, as illustrated in FIG. 4*e*. Engaging the dock member coupling 306*c* with the dock plug coupling 308 secures the dock plug 306 to the dock member 302 such that the dock plug 306 is held immediately adjacent the top surface 302*c* of the dock member 302. Furthermore, the power adapter cord 318 may be wrapped around the power adapter member 316 and in a stored position B such that the power adapter cord 318 is positioned between the dock member coupling 322 on the power adapter member 316 and the flexible member 314, as illustrated in FIG. 4*e*. As can be seen from Figures, the connection member 314 is operable to orient the dock member 302 relative to the power adapter member 316 in a number of positions. For example, FIGS. 3*a*, 3*b*, 3*c*, 3*d*, and 3*e* illustrate the dock member 302 and the power adapter member 316 oriented in a substantially co-linear orientation relative to each other. However, FIGS. 4*d* and 4*e* illustrate the dock member 302 and the power adapter member 316 oriented at an angle relative to each other with the power adapter member coupling 310 spaced apart from the dock member coupling 322. Furthermore, FIG. 4*f* illustrates the dock member 302 and the power adapter member 316 oriented substantially parallel to each other such that the power adapter member coupling 310 engages the dock member coupling 322. Engagement of the power adapter member coupling 310 with the dock member coupling 322 secures the dock member 302 to the power adapter member 316 such that the side surface 316*f* of the power adapter member 316 is held adjacent the side surface 302*f* of the dock member 302. As can be seen in FIG. 4*f*, with the power adapter member coupling 310 engaging the dock member coupling 322, the power adapter cord 318 is held in the stored position B. While a range of motion of the connecting member 314 and the dock and power adapter system 300 has been illustrated and described, one of skill in the art will recognize that the present disclosure is not so limited, and the connecting member 314 may flex or otherwise allow motion of the dock member 302 relative to the power adapter member 316 and into a variety of different orientations while still remaining within the scope of the present disclosure. Thus, a system and method have been described that provide power to an IHS, provide an expansion dock to the IHS, and provide cable management for cords in the system when the system is not in use.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A portable dock and power adapter system, comprising:

a dock member including a power adapter member coupling, a plurality of information handling system (IHS) component connectors, and a dock plug that is electrically coupled to the plurality of IHS component connectors and extends from the dock member;

a power adapter member including a dock member coupling and a power adapter plug that is electrically coupled to the dock plug and that extends from the power adapter member; and a connecting member extending between the power adapter member and the dock member, wherein the connecting member is operable to orient the power adapter member and the dock member such that the dock member coupling is spaced apart from the power adapter member coupling, and wherein the connecting member is operable to orient the power adapter member and the dock member such that the dock member coupling engages the power adapter member coupling.

2. The system of claim 1, wherein the connecting member is coupled to a first end of the power adapter member, and wherein the power adapter plug includes a power adapter cord that extends from a distal end of the power adapter member that is located opposite the power adapter member from the first end.

3. The system of claim 1, wherein the connecting member is coupled to a first end of the dock member, and wherein the dock plug includes a dock cord that extends from a distal end of the dock member that is located opposite the dock member from the first end.

4. The system of claim 1, wherein the dock member includes a dock plug coupling that is operable to engage the dock plug in order to couple the dock plug directly to the dock member.

5. The system of claim 1, further comprising:

a data coupling that extends from the dock plug and that is electrically coupled to each of the plurality of IHS component connectors; and a power coupling that extends from the dock plug and that is electrically coupled to the power adapter plug through the power adapter member.

6. The system of claim 1, wherein the power adapter plug includes a power adapter cord that extends from the power adapter member and that is operable to be wrapped around the power adapter member in a stored position, and wherein the power adapter cord is also operable to be held in the stored position when the dock member coupling engages the power adapter coupling.

7. The system of claim 1, wherein the connecting member comprises a flexible member.

8. The system of claim 1, wherein the power adapter member includes an IHS connector that is electrically coupled to the power adapter plug.

9. An information handling system (IHS), comprising:

an IHS chassis that houses a processor and that includes at least one IHS connector that is coupled to the processor;

a dock member including a power adapter member coupling, a plurality of IHS component connectors, and a dock plug that is electrically coupled to the plurality of IHS component connectors, extends from the dock member, and is operable to engage the at least one IHS connector to couple the plurality of IHS component connectors to the processor;

a power adapter member including a dock member coupling and a power adapter plug that is electrically coupled to the dock plug and that extends from the power adapter member; and a connecting member extending between the power adapter member and the dock member, wherein the connecting member is operable to orient the power adapter member and the dock member such that the dock member coupling is spaced apart from the power adapter member coupling, and wherein the connecting member is operable to orient the power adapter member and the dock member such that the dock member coupling engages the power adapter member coupling.

10. The system of claim 9, wherein the connecting member is coupled to a first end of the power adapter member, and wherein the power adapter plug includes a power adapter cord that extends from a distal end of the power adapter member that is located opposite the power adapter member from the first end.

11. The system of claim 9, wherein the connecting member is coupled to a first end of the dock member, and wherein the dock plug includes a dock cord that extends from a distal end of the dock member that is located opposite the dock member from the first end.

12. The system of claim 9, wherein the dock member includes a dock plug coupling that is operable to engage the dock plug in order to couple the dock plug directly to the dock member.

13. The system of claim 9, wherein the at least one IHS connector includes a data connector and a power connector that are located adjacent each other on the IHS chassis and that are coupled to the processor.

14. The system of claim 10, further comprising:

a data coupling that extends from the dock plug and that is electrically coupled to each of the plurality of IHS component connectors, wherein the data coupling is operable to engage the data connector; and a power coupling that extends from the dock plug and that is electrically coupled to the power adapter plug through the power adapter member, wherein the power coupling is operable to engage the power connector.

15. The system of claim 9, wherein the power adapter plug includes a power adapter cord that extends from the power adapter member and that is operable to be wrapped around the power adapter member in a stored position, and wherein the power adapter cord is also operable to be held in the stored position when the dock member coupling engages the power adapter coupling.

16. The system of claim 9, wherein the connecting member comprises a flexible member.

17. The system of claim 9, wherein the power adapter member includes an IHS connector that is electrically coupled to the power adapter plug.

18. A method for providing a dock and power to an information handling system (IHS), comprising:

providing a dock member and a power adapter member that are moveably coupled together by a flexible connecting member that is operable to change the orientation of the dock member relative to the power adapter member, wherein the dock member includes a plurality of IHS component connectors;

coupling a dock plug that extends from the dock member to at least one IHS connector that is located on an IHS chassis, wherein the at least one IHS connector is electrically coupled to a processor that is housed in the IHS chassis;

coupling a power adapter plug that extends from the power adapter member to a power source in order to provide power to the processor; and coupling at least one IHS component to at least one IHS component connector on the dock member to electrically couple the IHS component to the processor.

19. The method of claim 18, wherein the coupling the dock plug to the at least one IHS connector comprises coupling a data coupler that extends from the dock plug to an IHS data connector located on the IHS chassis and coupling a power coupler that extends from the dock plug to an IHS power connector that is located on the IHS chassis adjacent the IHS data connector.

20. The method of claim 18, further comprising:

decoupling the power adapter plug from the power source and positioning a power adapter cord, which extends between the power adapter plug and the power adapter member, in a stored position where the power adapter cord is wrapped around the power adapter member; and moving the power adapter member relative to the dock member using the connection member such that a power adapter coupling on the dock member engages a dock member coupling on the power adapter member and holds the power adapter cord in the stored position.

* * * * *